United States Patent [19]

Oda et al.

[11] Patent Number: 4,714,058

[45] Date of Patent: Dec. 22, 1987

[54] SPARK-IGNITED INTERNAL COMBUSTION ENGINE

[75] Inventors: Hiroyuki Oda; Akira Kageyama, both of Hiroshima, Japan

[73] Assignee: Mazda Motor Corporation, Japan

[21] Appl. No.: 803,606

[22] Filed: Dec. 2, 1985

[30] Foreign Application Priority Data

Dec. 10, 1984 [JP] Japan ..... 59-261335
Dec. 14, 1984 [JP] Japan ..... 59-265085

[51] Int. Cl.[4] ..... F01P 3/02; F01L 1/26

[52] U.S. Cl. ..... 123/90.22; 123/90.23; 123/90.44; 123/41.82 R; 123/41.32

[58] Field of Search ..... 123/41.32, 90.44, 41.82 R, 123/90.27, 90.22, 90.23

[56] References Cited

U.S. PATENT DOCUMENTS

| | | | |
|---|---|---|---|
| 2,078,499 | 4/1937 | Ljungstrom | 123/41.32 |
| 3,315,652 | 4/1967 | Ries et al. | 123/41.32 |
| 3,492,977 | 2/1970 | Fager | 123/41.32 |
| 3,650,249 | 3/1972 | Honda | 123/41.32 |
| 4,121,550 | 10/1978 | Wand et al. | 123/41.32 |
| 4,365,593 | 12/1982 | Pomfret | 123/41.32 |
| 4,471,726 | 9/1984 | Seidl | 123/41.82 R |
| 4,549,510 | 10/1985 | Miyakoshi et al. | 123/90.44 |

FOREIGN PATENT DOCUMENTS

| | | | |
|---|---|---|---|
| 1996762 | 5/1968 | Fed. Rep. of Germany . | |
| 3123538 | 3/1982 | Fed. Rep. of Germany . | |
| 27125 | 9/1970 | Japan | 123/41.32 |
| 31407 | 9/1971 | Japan | 123/41.32 |
| 102506 | 6/1982 | Japan . | |
| 628399 | 2/1982 | Switzerland . | |
| 2081809 | 2/1982 | United Kingdom . | |

*Primary Examiner*—Ira S. Lazarus
*Attorney, Agent, or Firm*—Gerald J. Ferguson, Jr.; Michael P. Hoffman; Michael J. Foycik, Jr.

[57] ABSTRACT

In a spark-ignited engine in which a spark plug is supported so that its igniting tip is centrally located in the combustion chamber, a bore for forming a coolant passage is provided in the wall of the cylinder head defining the combustion chamber to extend between an exhaust port and a threaded bore into which the spark plug is screwed. The bore is formed to extend from a cooland inlet formed in the lower side of the cylinder head through which coolant from the cylinder block enters the cylinder head to the water jacket formed in the cylinder head so that the coolant from the cylinder block flows through the bore under the pressure difference between the coolant inlet and the water jacket.

13 Claims, 10 Drawing Figures

SPARK-IGNITED INTERNAL COMBUSTION ENGINE

BACKGROUND OF THE INVENTION

1. Field of the Invention

This invention relates to a spark-ignited internal combustion engine, and more particularly to a spark-ignited internal combustion engine in which the spark plug is supported so that the igniting tip of the spark plug is centrally positioned in the combustion chamber.

2. Description of the Prior Art

There has been known a spark-ignited engine in which a spark plug is centrally located in the combustion chamber in order to improve ignition of the air-fuel mixture in the combustion chamber and propagation of flame. However, in the case of engines provided with an intake port of a wide cross section or with a plurality of intake ports in order to increase the volumetric efficiency, it is difficult to locate the spark plug at the center of the combustion chamber due to limited room on the intake port side of the cylinder head. In Japanese Unexamined Patent Publication No. 57(1982)-102506, there is disclosed an internal combustion engine in which the spark plug is obliquely supported on the exhaust port side, where the remaining room is relatively large, and only the igniting tip is centrally located in the combustion chamber. This engine has a pair of intake ports 3 and a pair of exhaust ports 4, as shown in FIGS. 9 and 10, extending from opposite sides of the cylinder head 1 to a combustion chamber 2. A spark plug 5 is obliquely supported between the exhaust ports 4 (where room for supporting the spark plug can be obtained relatively easily) so that the igniting tip 5*a* is centrally located in the combustion chamber 2. With this arrangement, the spark plug can be supported to centrally locate the igniting tip in the combustion chamber in order to improve ignition of the air-fuel mixture and propagation of flame even in engines having a wide intake port or a plurality of intake ports.

However, this arrangement is disadvantageous in that since the spark plug is supported near the exhaust port through which hot exhaust gas is discharged, the male screw portion of the spark plug screwed into the wall portion of the combustion chamber is adversely affected by the heat transmitted thereto from the exhaust port. This thermal effect is especially significant in the case of a multicylinder engine in which thermal load is heavy and promotes deterioration of the spark plug.

SUMMARY OF THE INVENTION

In view of the foregoing observations and description, the primary object of the present invention is to provide a spark-ignited engine having a spark plug supported so that its igniting tip is centrally located in the combustion chamber in which the male screw portion of the spark plug is thermally protected from the heat of exhaust passing through the exhaust port.

In the spark-ignited engine of the present invention, a bore for forming a coolant passage is provided in the wall of the cylinder head defining the combustion chamber to extend between the exhaust port and the threaded bore into which the spark plug is screwed.

For example, the bore is formed to extend from a coolant inlet formed in the lower side of the cylinder head through which coolant from the cylinder block enters the cylinder head to the water jacket formed in the cylinder head so that the coolant from the cylinder block flows through the bore under the pressure difference between the coolant inlet and the water jacket.

The coolant flowing through the bore cools the male screw portion of the spark plug to thermally protect the spark plug. Thus, in accordance with the present invention, the spark plug can be thermally protected without substantially complicating the engine structure.

DESCRIPTION OF THE PREFERRED EMBODIMENTS

Figure 1:
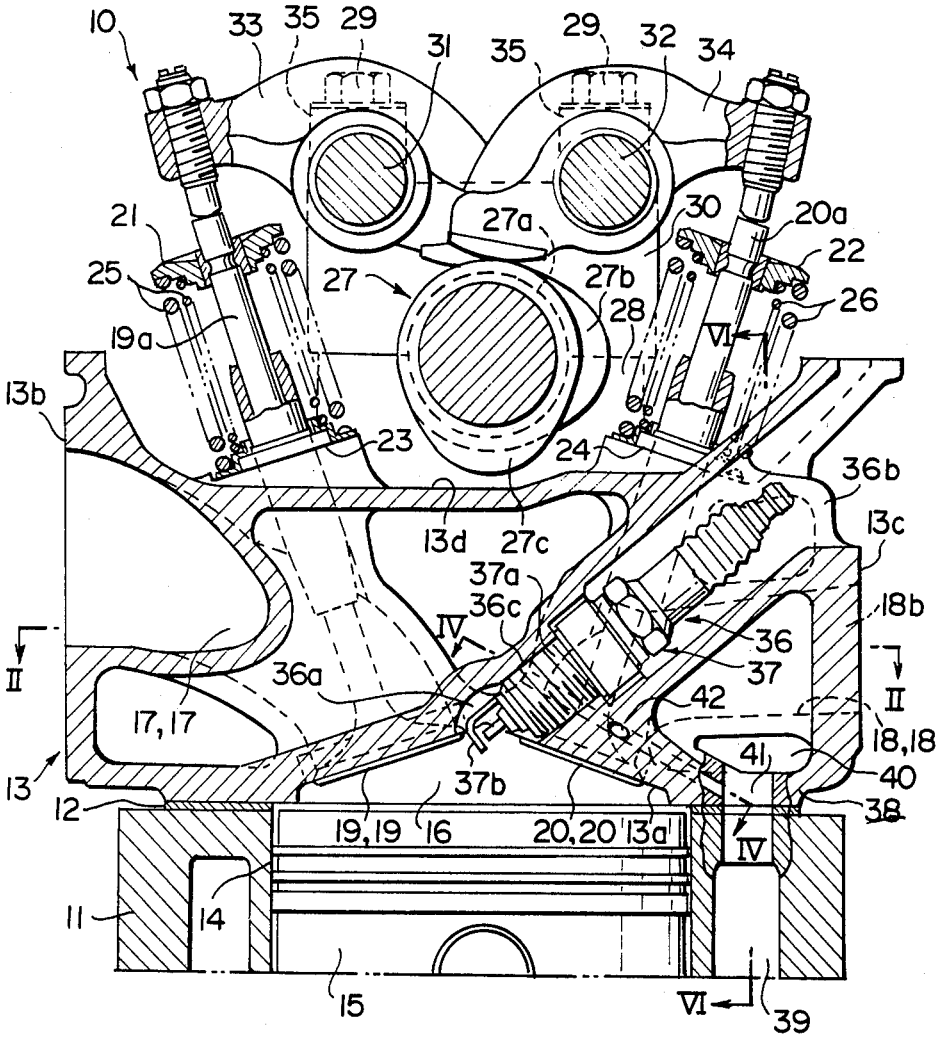
FIG. 1 is a fragmentary cross-sectional view of a spark-ignited engine in accordance with an embodiment of the present invention.
Figure 2:
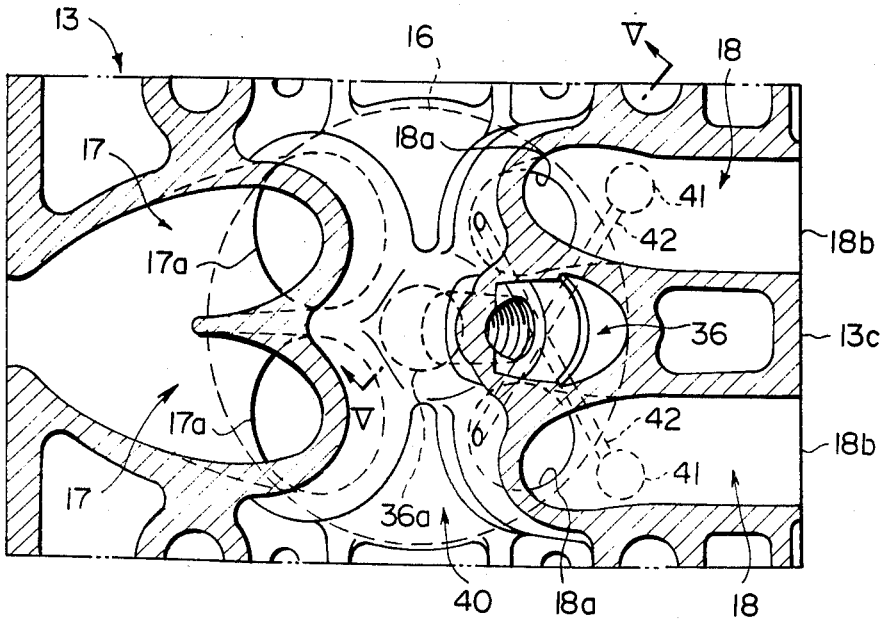
FIG. 2 is a cross-sectional view taken along line II—II in FIG. 1.
Figure 3:
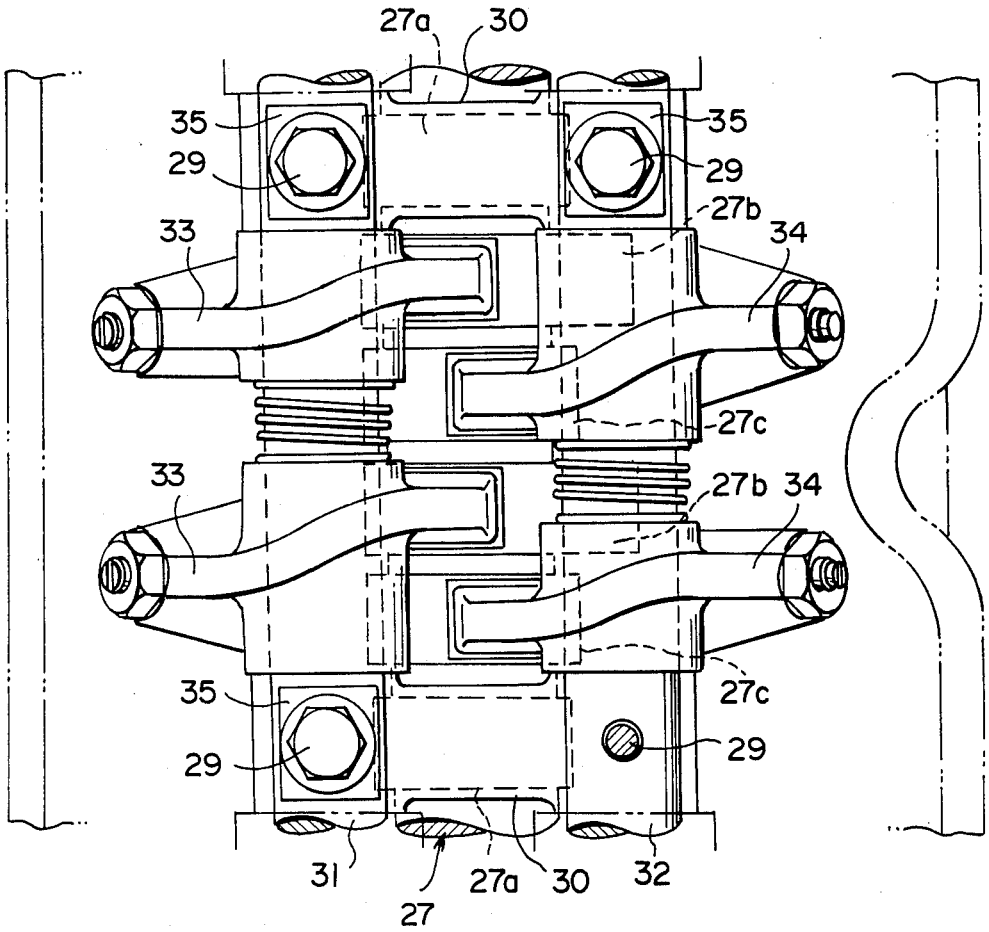
FIG. 3 is a plan view of the engine shown in FIG. 1.

In FIGS. 1 to 3, a single-overhead-camshaft engine 10 in accordance with an embodiment of the present invention comprises a cylinder block 11 having a plurality of cylinders 14 arranged in line, and a cylinder head 13 mounted on the cylinder block 11 with a gasket 12 intervening therebetween. The inner surface of each cylinder 14, the top surface of the piston 15 received in the cylinder 14 and a recessed portion 13*a* formed in the lower surface of the cylinder head 13 opposed to each cylinder 14 define a combustion chamber 16. Each of the combustion chambers 16 is provided with a pair of intake ports 17 leading to the combustion chamber 16 from one side 13*b* of the cylinder head 13, and a pair of exhaust ports 18 leading to the combustion chamber 16 from the other side 13*c* of the cylinder head 13. The ends 17*a* and 18*a* of the intake and exhaust ports 17 and 18 for each combustion chamber 16 opening in the recessed portion 13*a* of the cylinder head 13 are arranged at the respective corners of a rectangle. The intake ports 17 and the exhaust ports 18 are provided with intake valves 19 and exhaust valves 20. The stems 19*a* of the intake valves 19 and the stems 20*a* of the exhaust valves 20 extend upward to project from the upper surface 13*d* of the cylinder head 13. Each of the intake valves 19 is urged toward the closed position by a valve spring 25 compressed between a spring retainer 21 and a spring seat portion 23 formed in the upper surface 13*d* of the cylinder head 13 at a portion through which the valve stem 19*a* projects. Similarly, each of the exhaust valves 20 is urged toward the closed position by a valve spring 26 compressed between a spring retainer 22 and a spring seat portion 24 formed in the upper surface 13*d* of the cylinder head 13 at a portion through which the valve stem 20*a* projects.

A camshaft 27 extends in parallel to the crankshaft (not shown) on the upper surface 13*d* of the cylinder head 13 between the row of the intakes valves 19 and the row of the exhaust valves 20. Journals 27*a* of the camshaft 27 are received and supported for rotation in bearing openings defined by upwardly opening semicircular recesses formed in bearing walls 28 provided at opposite ends of the cylinder head 13 and between adjacent cylinders, and downwardly opening semicircular recesses formed in bearing caps 30 which are fixedly mounted on the respective bearing walls 28 by bolts 29. A pair of cams 27*b* for operating the intake valves 19 and a pair of cams 27*c* for operating the exhaust valves 20 are formed on the camshaft 27 between each pair of adjacent journals 27*a*. A pair of rocker arm shafts 31 and 32 extend in parallel to the camshaft 27 above the camshaft 27 on opposite sides thereof. A pair of rocker arms 33 for operating the intake valves 19 for each cylinder are supported for pivotal movement on the rocker arm shaft 31 and a pair of rocker arms 34 for operating the exhaust valves 20 for each cylinder are supported for pivotal movement on the rocker arm shaft 32. The rocker arm shafts 31 and 32 are fixed on the bearing caps 30 by said bolts 29 by way of retainer members 35. The intake valves 19 and the exhaust valves 20 are opened and closed at respective predetermined times upon rotation of the camshaft 27 in the known manner.

Spark plugs 37 are screwed into plug holes 36 formed in the cylinder head 13. Each plug hole 36 is obliquely formed between the exhaust ports 18 for each cylinder so that its inner end 36*a* opens at a position surrounded by the ends 17*a* and 18*a* of the intake ports 17 and the exhaust ports 18 or the center of the combustion chamber 16. The outer end 36*b* of the plug hole 36 opens at the corner of the cylinder head 13 between the upper surface 13*d* and the side 13*c* in which the outer ends 18*b* of the exhaust ports 18 open and between the outer ends 18*b* of the exhaust ports 18. This arrangement is advantageous in that the spark plug can 37 can be screwed into and removed from the plug hole 36 without interfering with the camshaft 27, the exhaust valve driving mechanism and the like. The part of the plug hole 36 adjacent to the inner end 36*a* is threaded to form a female screw portion 36*c* with which the male screw portion 37*a* of the spark plug 37 is engaged. When the spark plug 37 is screwed into the plug hole 36, the igniting tip 37*b* of the spark plug 37 projects into the combustion chamber 16 from the center of the top surface of the combustion chamber 16.

Figure 4:
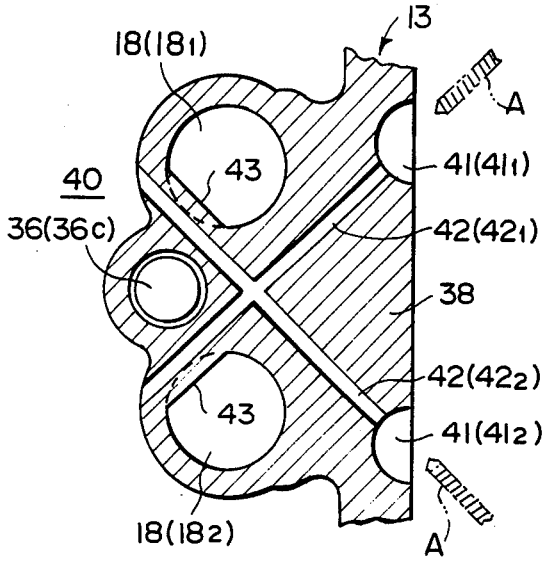
FIG. 4 is a cross-sectional view taken along line IV—IV in FIG. 1.
Figure 5:
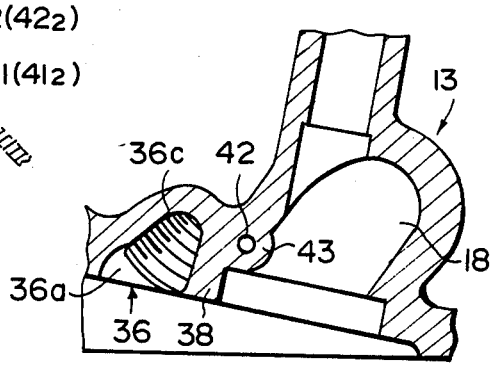
FIG. 5 is a cross-sectional view taken along line V—V in FIG. 2.

As shown in FIGS. 1, 2 and 4, a coolant inlet 41 for introducing cooling water from a water jacket 39 in the cylinder block 11 into a water jacket 40 in the cylinder head 13 is formed in the lower deck 38 of the cylinder head 13 below each exhaust port 18. As clearly shown in FIG. 4, a pair of bores 42 are formed for each cylinder. One of the bores $42_1$ extends from the upper (as seen in FIG. 4) coolant inlet $41_1$ through the lower deck 38 passing between the plug hole 36 and the lower exhaust port $18_2$ to communicate the upper coolant inlet $41_1$ with the water jacket 40, and the other bore $42_2$ extends from the lower coolant inlet $41_2$ through the lower deck 38 passing between the plug hole 36 and the upper exhaust port $18_1$ to communicate the lower coolant inlet $41_2$ with the water jacket 40, the bores $42_1$ and $42_2$ intersecting each other. Thus, the female screw portion 36*c* of the plug hole 36 is insulated from the exhaust ports 18 by the bores 42 as seen in FIG. 4. It is preferred that the position and the direction of each bore 42 be selected so that the bore 42 can be drilled by a drill (indicated at A in FIG. 4) from the lower surface of the cylinder head 13 through the coolant inlet 41. Further, the exhaust port 18 is provided with a thickened portion 43 at a part adjacent to the bore 42 to prevent the drill A from penetrating into the exhaust port 18 when drilling the bore 42 to communicate the bore 42 with the exhaust port 18.

Figure 6:
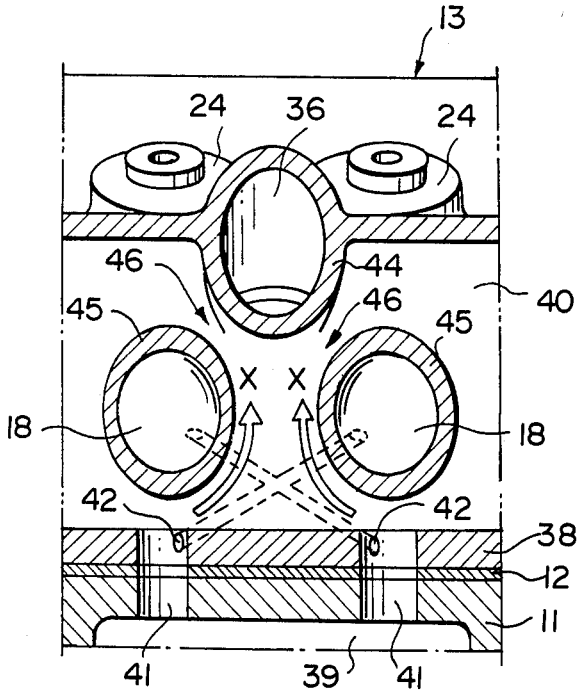
FIG. 6 is a cross-sectional view taken along line VI—VI in FIG. 1.

As shown in FIG. 6, the wall 44 defining the plug hole 36 and the walls 45 defining the exhaust ports 18 are separated by a coolant passage 46 formed therebetween and the coolant introduced into the water jacket 40 through the coolant inlets 41 flows through the coolant passage 46 between the walls 44 and 45 as shown by arrow X.

In the arrangement described above, since the spark plug 37 is screwed into the plug hole 36 obliquely formed between the exhaust ports 18, the igniting tip 37*b* of the spark plug 37 can be centrally located in the combustion chamber 16 so that the air-fuel mixture in the combustion chamber can be well ignited and the flame in the combustion chamber can be well propagated even though a pair of wide intake ports 17 are formed in the cylinder head 13.

When the spark plug 37 is disposed between the exhaust ports 18, heat of hot exhaust passing through the exhaust ports 18 is transmitted to the spark plug 37, causing thermal deterioration of the spark plug 37, especially the female screw portion 37*c* screwed into the lower deck 38 facing the combustion chamber 16. However, in the engine of this embodiment, the coolant passing through the bores 42 under the pressure difference between the coolant inlets 41 and the water jacket 40 cools the female screw portion 37*c* of the spark plug 37. Further, the coolant passing through the coolant passage 46 formed between the walls 45 defining the exhaust ports 18 and the wall 44 defining the plug hole 36 cools the spark plug 37 by way of the wall 44. Thus, the spark plug 37 can be effectively protected from thermal deterioration.

Figure 7:
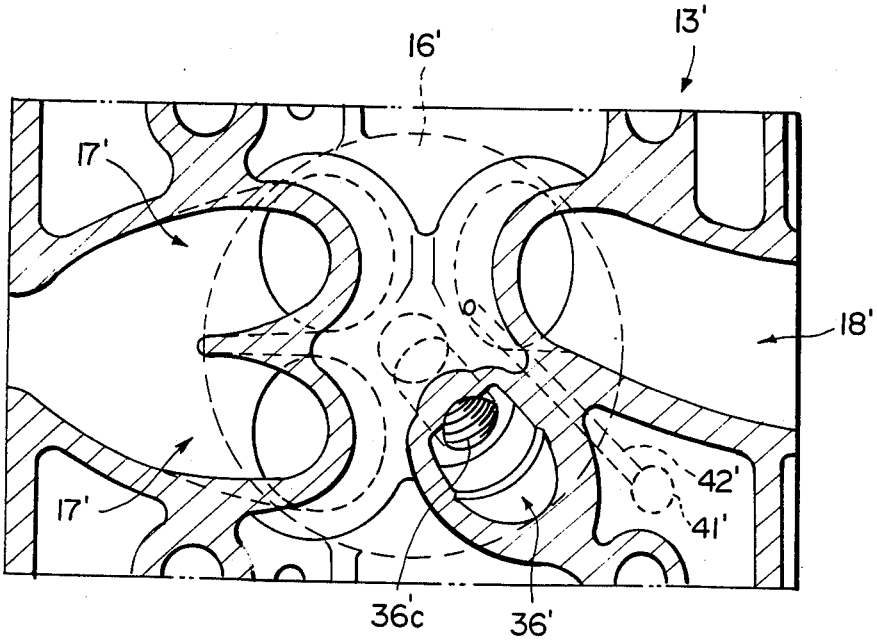
FIG. 7 is a cross sectional view of a cylinder head employed in the spark-ignited engine in accordance with another embodiment of the present invention.
Figure 8:
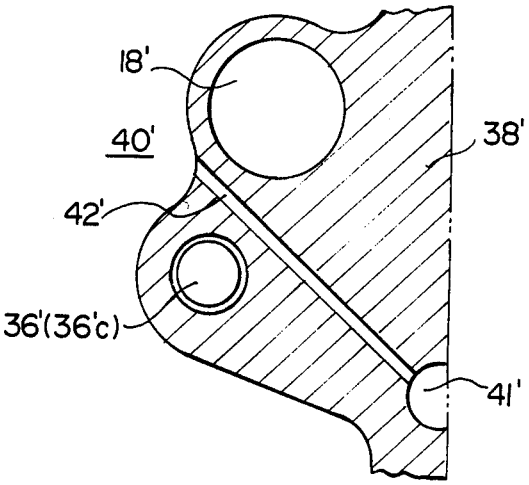
FIG. 8 is a fragmentary cross-sectional view of the cylinder head shown in FIG. 7.
Figure 9:
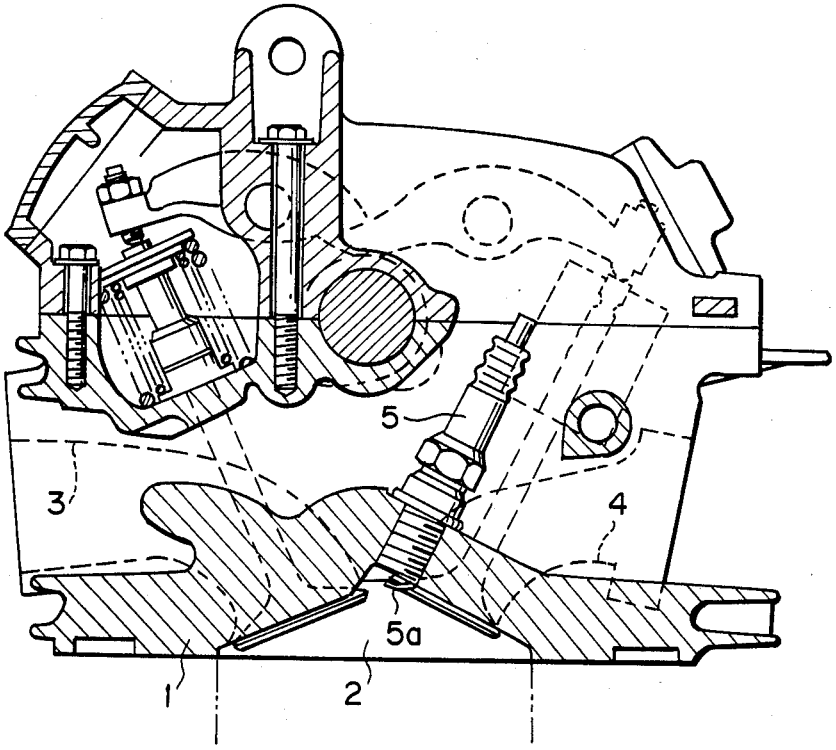
FIG.9 PRIOR ART
FIG. 9 is a view similar to FIG. 1 but showing an engine in accordance with the prior art.
Figure 10:
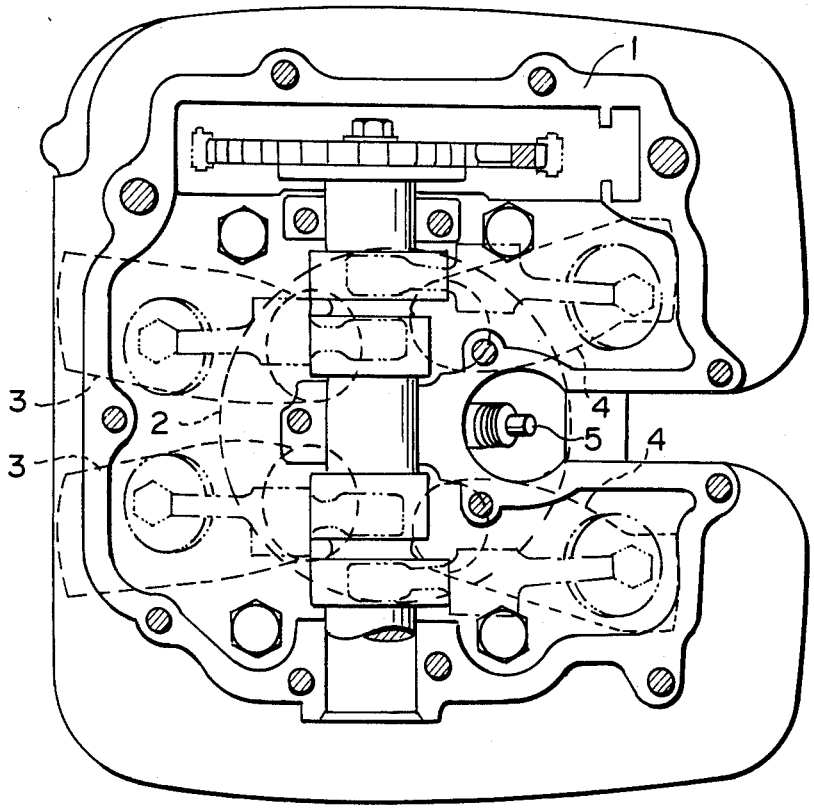
FIG. 10 PRIOR ART
FIG. 10 is a plan view of the engine shown in FIG. 9.

The spark-ignited engine in accordance with another embodiment of the present invention shown in FIGS. 7 and 8 has a pair of intake ports 17′ and a single exhaust port 18′. Also in this engine, there is not sufficient room for the spark plug on the intake port side of the cylinder head 13′ and accordingly the plug hole 36′ is formed on the exhaust port side of the cylinder head 13′. Also in this case, heat of exhaust passing through the exhaust port 18′ is transmitted to the spark plug (not shown in FIGS. 7 and 8) and thermally deteriorates it. In order to cool the spark plug, a bore 42′ is formed in the lower deck 38′ of the cylinder head 13′ to extend from the coolant inlet 41′ to the water jacket 40′ passing between the exhaust port 18′ and the female screw portion 36′ of the plug hole 36′. The coolant flowing through the bore 42′ cools the spark plug screwed into the plug hole 36′ as in the previous embodiment.

We claim:

1. A spark-ignited engine comprising a cylinder block having at least one cylinder in which a piston is slidably received, and a cylinder head fixedly mounted on the cylinder block to form at least one combustion chamber therebetween, each combustion chamber being provided with a plurality of intake ports each of which is opened and closed by an intake valve, at least one exhaust port which is opened and closed by an exhaust valve and a spark plug screwed into a threaded plug hole formed in the cylinder head so that the igniting tip thereof projects into the combustion chamber wherein the improvement comprises at least one bore for forming a coolant passage provided in the wall of the cylinder head defining the combustion chamber to extend between the exhaust port and the plug hole, a single camshaft for driving the intake valve and the exhaust valve over the combustion chamber, wherein a plurality of the intake ports are located on one side with respect to the camshaft and the at least one exhaust port and the spark plug are located on another side with respect to the camshaft, and the coolant passage is a linear passage having one end communciating with a coolant inlet formed in the cylinder head through which coolant from the cylinder block enters the cylinder head, and another end opening into a water jacket above the combustion chamber.

2. A spark-ignited engine as defined in claim 1 which is provided with a pair of exhaust ports and in which said plug hole is obliquely formed on the exhaust port side between the pair of exhaust ports so that the igniting tip of the spark plug is centrally located in the combustion chamber when the spark plug is screwed into the plug hole.

3. A spark-ignited engine as defined in claim 2 in which a pair of said bores are provided on opposite sides of the plug hole.

4. A spark-ignited engine as defined in claim 1 in which each combustion chamber is provided with a single exhaust port.

5. A spark-ignited engine as defined in claim 4 in which the cross sectional area of the intake port is larger than that of the exhaust port.

6. A spark-ignited engine as defined in claim 5 in which each combustion chamber is provided with a pair of intake valves.

7. A spark-ignited engine as defined in claim 6 in which said bore is linear in shape and extends to communicate a coolant inlet formed in the cylinder head through which coolant from the cylinder block enters the cylinder head with a water jacket formed in the cylinder head.

8. A spark-ignited engine as defined in claim 3 in which each of said bores is linear in shape and extends to communciate a coolant inlet formed in the cylinder head through which coolant from the cylinder block enters the cylinder head with a water jacket formed in the cylinder head.

9. A spark-ignited engine as defined in claim 1 in which said bore is formed along the upper wall of the combustion chamber.

10. A spark-ignited engine comprising a cylinder block having at least one cylinder in which a piston is slidably received, and a cylinder head fixedly mounted on the cylinder block to form at least one combustion chamber therebetween, each combustion chamber being provided with at least one intake port which is opened and closed by an intake valve, at least one exhaust port which is opened and closed by an exhaust valve and a spark plug screwed into a threaded plug hole formed in the cylinder head so that the igniting tip thereof projects into the combustion chamber wherein in the improvement comprises at least one bore for forming a coolant passage provided in the wall of the cylinder head defining the combustion chamber to extend between the exhaust port and the plug hole, wherein one of said bores extends from below one of the exhaust ports and opens above the other exhaust port passing between the plug hole and said other exhaust port and the other bore extends from below said other exhaust port and opens above said one exhaust port passing between the plug hole and said one exhaust port.

11. A spark-ignited engine as defined in claim 10 in which said bores are communicated with each other at a portion between the exhaust ports.

12. A spark-ignited engine as defined in claim 11 in which a water jacket is formed between the plug hole and each of the exhaust ports.

13. A spark-ignited engine coomprising a cylinder block having at least one cylinder in which a piston is slidably received, and a cylinder head fixedly mounted on the cylinder block to form at least one combustion chamber therebetween, each combustion chamber being provided with at least one intake port which is opened and closed by an intake valve, at least one exhaust port which is opened and closed by an exhaust valve and a spark plug screwed into a threaded plug hole formed in the cylinder head so that the igniting tip thereof projects into the combustion chamber wherein the improvement comprises that at least one bore for forming a coolant passage is provided in the wall of the cylinder head defining the combustion chamber to extend between the exhaust port and the plug hole, one of said bores extending from a portion communicating with a water jacket formed in the cylinder block and opening above one exhaust port passing between the plug hole and said one exhaust port and the other bore extending from a portion communicating with the water jacket formed in the cylinder block and opening above the other exhaust port passing between the plug hole and said other exhaust port.

* * * * *